US005674114A

United States Patent [19]

Miller et al.

[11] Patent Number: 5,674,114

[45] Date of Patent: Oct. 7, 1997

[54] UNIVERSAL POLISHING PLATE FOR POLISHING MACHINE

[75] Inventors: Nancy Lebeis Miller, Harrisburg; Ronald Allan Hileman, Camp Hill; Vinod Joshua Franklin, Harrisburg, all of Pa.

[73] Assignee: The Whitaker Corporation, Wilmington, Del.

[21] Appl. No.: 337,585

[22] Filed: Nov. 10, 1994

[51] Int. Cl.[6] ..... B24B 7/00

[52] U.S. Cl. ..... 451/278; 451/41; 451/365

[58] Field of Search ..... 451/41, 285, 286, 451/287, 288, 278, 365, 374; 269/43, 268

[56] References Cited

U.S. PATENT DOCUMENTS

| | | | |
|---|---|---|---|
| 4,693,035 | 9/1987 | Doyle | 51/125 |
| 4,819,386 | 4/1989 | Struyf | 269/43 |
| 4,831,784 | 5/1989 | Takahashi | 51/131.1 |
| 4,905,415 | 3/1990 | Moulin | 51/124 R |
| 5,109,460 | 4/1992 | Baek et al. | 385/115 |
| 5,140,779 | 8/1992 | Grois | 451/365 |
| 5,216,846 | 6/1993 | Takahashi | 51/326 |
| 5,321,917 | 6/1994 | Franklin et al. | 51/217 R |
| 5,351,445 | 10/1994 | Takahashi | 451/41 |

FOREIGN PATENT DOCUMENTS

| | | |
|---|---|---|
| 0 579 056 A1 | 1/1994 | European Pat. Off. . |
| 0 621 107 A1 | 10/1994 | European Pat. Off. . |
| 0 657 247 A2 | 6/1995 | European Pat. Off. . |

OTHER PUBLICATIONS

Operating Manual: "SFP-550 APC Polishing Machine"; P/N C15305-5; Issued Mar. 23, 1993; JDS Fitel Inc. (One page).

International Search Report.

*Primary Examiner*—Eileen P. Morgan

[57] ABSTRACT

Polishing machines, fixtures, and apparatus for setting up connectors of varying geometries on polishing fixtures. The setup plates have a plurality of axial holes disposed around the perimeter of the setup plate that will receive optical fibers. The setup plate further comprises a reference surface for providing interference with ferrules in the connectors so that the ferrules protrude uniformly through the polishing fixtures. Since the polishing machines described herein can polish connectors of varying geometries at one time, these machines operate efficiently and cost-effectively.

10 Claims, 7 Drawing Sheets

UNIVERSAL POLISHING PLATE FOR POLISHING MACHINE

FIELD OF THE INVENTION

This invention relates generally to polishing fixtures for polishing ferrules and optical fibers in connectors. More specifically, this invention relates to polishing fixtures which can house a plurality of connectors having varying geometries so that the ferrules and optical fibers in the ferrules can be polished efficiently and accurately.

BACKGROUND OF THE INVENTION

Polishing machines which are known in the art are adapted to grind and polish the ends of optical fibers with a rotating abrasive disk. In prior polishing machines, optical fibers are secured in a fixture having a flat bottom, and the end of the optical fiber that is to be polished projects slightly below the bottom surface of the fixture to make contact with the abrasive so that the abrasive can grind the optical fiber to the correct standards. An example of such a polishing machine is shown in U.S. Pat. No. 4,905,415, Moulin which discloses a grinding and polishing machine as substantially described above.

Connectors containing optical fibers and ferrules which are polished by these polishing machines have various constructions, lengths, and geometries. In prior polishing fixtures, only a single geometry connector can be polished at a time. Typically, these single geometry fixtures with optical fibers attached thereto are lowered onto a rotating abrasive disk and made to undergo a standard polishing pattern such as a circle or figure eight. Generally, there are three or more stages of polishing that must be accomplished in sequence from relatively coarse abrasive to very fine. See U.S. Pat. No. 5,216,846, Takahashi.

Polishing machines tend to be expensive, precision apparatuses which require many polishing fixtures in order to accommodate different geometry connectors. Since polishing fixtures tend to be expensive, when only one diameter connector can be inserted into the polishing fixture so that the ferrules and optical fibers can be polished, an inefficient and expensive process for polishing is undertaken. Oftentimes, it is not necessary to polish many of the same geometry connectors at once, but rather, it is necessary to polish connectors of different geometries. Thus, since only a single geometry connector can be polished at any one time in prior polishing machines and polishing fixtures, a cumbersome and inefficient process has developed in the art for polishing optical fiber connectors.

Prior polishing machines also fail to ensure an accurate and uniform connector protrusion of the optical fibers and ferrules from the fixture. Uniform protrusion is especially important in order to achieve uniform polishing. However, prior polishing fixtures cause the connectors themselves to bottom on a shoulder where the tolerance between the shoulder and the connector at the interface affects the amount of protrusion. This further affects the polishing pressure on the connector tip which is even more severe if a connector needs to be repolished. Furthermore, prior polishing fixtures require shimming of the polishing surface to provide enough pressure on the connector tip.

There thus exists a long-felt need in the art for polishing machines which can provide uniform and accurate polishing of multi-geometry connectors simultaneously. These machines should provide polishing fixtures which can be easily loaded and unloaded, and which will ensure accurate and uniform protrusion of optical fibers and ferrules from the polishing fixtures onto the abrasive for polishing. These long-felt needs have not heretofore been fulfilled in the art.

SUMMARY OF THE INVENTION

Figure 1:
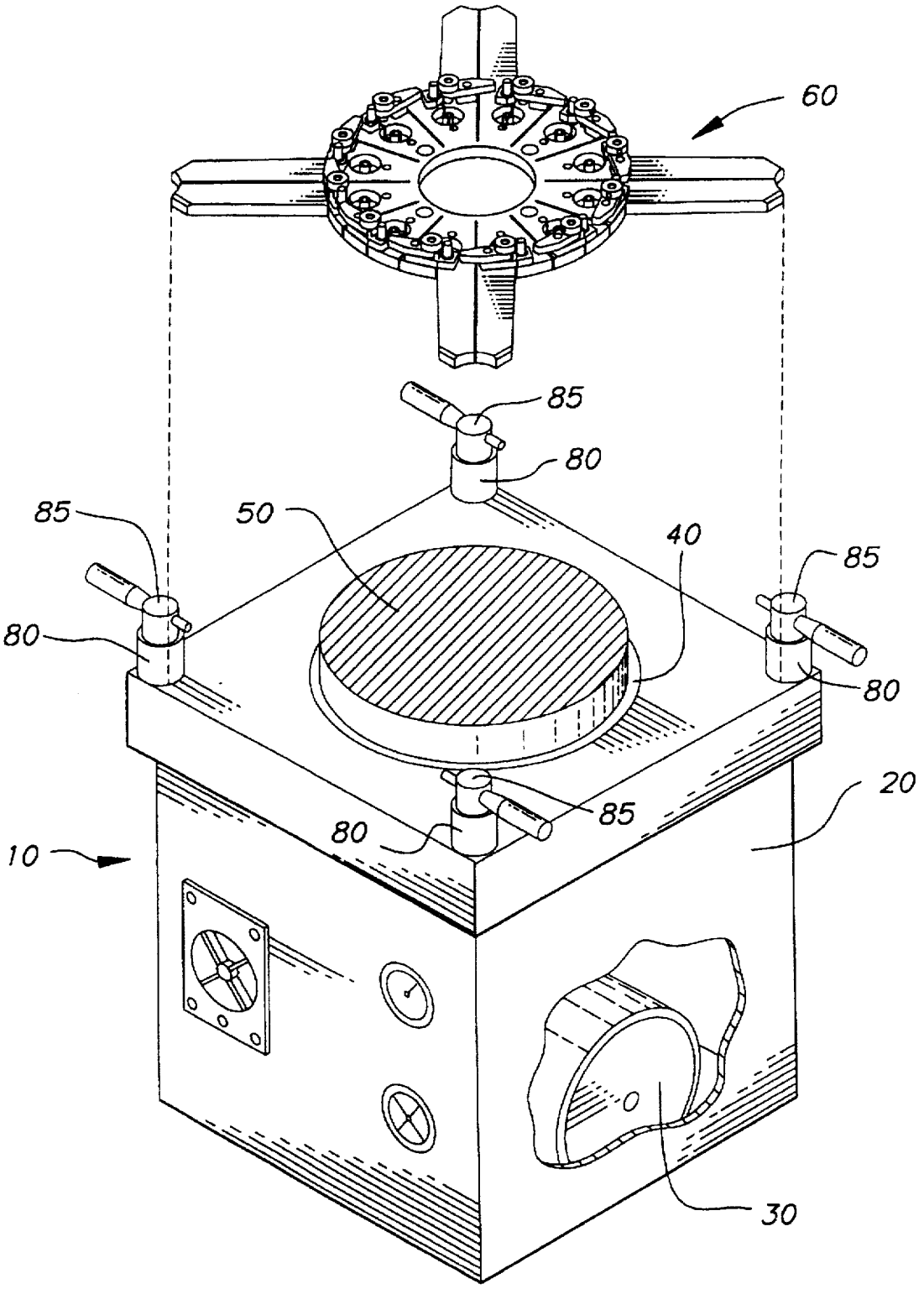
FIG. 1 is an exploded isometric view of a polishing machine with a universal polishing fixture provided in accordance with the present invention.

The aforementioned problems are solved and long-felt needs met by a setup plate for positioning up different connector styles on a polishing fixture so that the connectors can be polished in a polishing machine. In a preferred embodiment, the setup plate comprises a base member and alignment member formed on a bottom portion of the base member which provides mechanical interference with the ferrule to provide a substantially uniform protrusion for the ends of the ferrules from the polishing fixture.

Still more preferably, the alignment member comprises a circular reference surface having a plurality of holes disposed and at equal distances around the circumference of the reference surface, wherein the holes are adapted to receive the fiber-optic elements. In a more preferred aspect of the invention, the reference surface is adapted to provide mechanical interference with each ferrule such that each ferrule protrudes a uniform distance through ferrule receiving members in the polishing fixture The setup plate further comprises at least two registration pins on the reference surface for holding the reference surface in registration with the plurality of clamping members on the fixture. To this end, the fixtures further comprise a circular plate on which the clamping members are secured, the circular plate having a plurality of registration holes in engagement with the registration pins to hold the circular plate on the circular reference surface.

Still more advantageously, the circular plate further comprises a plurality of securing plates interfaced at the perimeter of the circular plate for holding the circular plate and clamping members against the base member. In a further preferred embodiment, the base member further comprises a plurality of tightening lugs which will tighten the securing plates to the base member to further secure the clamping members to the circular reference surface. In order to hold the connectors of varying geometries, the circular plate preferably comprises a plurality of nests which are adapted to receive the connectors of varying geometries.

Polishing fixtures, setup plates, and polishing machines provided in accordance with the present invention advantageously allow connectors of varying geometries to be polished at one time, and further ensure that a uniform protrusion of the ferrules is achieved. This allows a constant pressure to be placed on the optical elements to be polished, thereby ensuring that the optical elements are uniformly polished accurately and efficiently. Furthermore, since the polishing apparatus provided in accordance with the present invention can achieve a uniform and accurate protrusion of ferrules, the polishing process is efficiently realized, thereby reducing costs. Such results have not heretofore been achieved in the art. The invention will be best understood by reading the following detailed description of preferred embodiments in conjunction with the drawings which are first described briefly below.

DETAILED DESCRIPTION OF PREFERRED EMBODIMENTS

Referring now to the drawings wherein like reference numerals refer to like elements, a polishing machine 10 is shown in FIG. 1. The polishing machine generally comprises a sturdy housing 20 which houses a drive motor shown partially at 30 that is adapted to drive a table 40 which rotates. The table 40 rotates by means of a drive mechanism (not shown) interfaced to motor 30.

An abrasive material 50 is placed on the table 40 and has sufficient abradant qualities to grind down a ferrule 190 and an optical fiber terminated therein. The polishing operation endeavors to produce a uniformly polished ferrule 190 and fiber sufficient for use in a connector used in optical data transmission. It is important that a ferrule terminated with an optical fiber be adequately and uniformly polished at the ferrule endface. If the terminated ferrule is not polished adequately, data transmission through the ferrule 190 is degraded. An adequate polish on the ferrule 190 and optical fiber ensures good contact with a mating According to the teachings of the present invention, a universal polishing fixture 60 provides for clamping retention of the ferrule 190 independent of the connector geometry.

Figure 2:
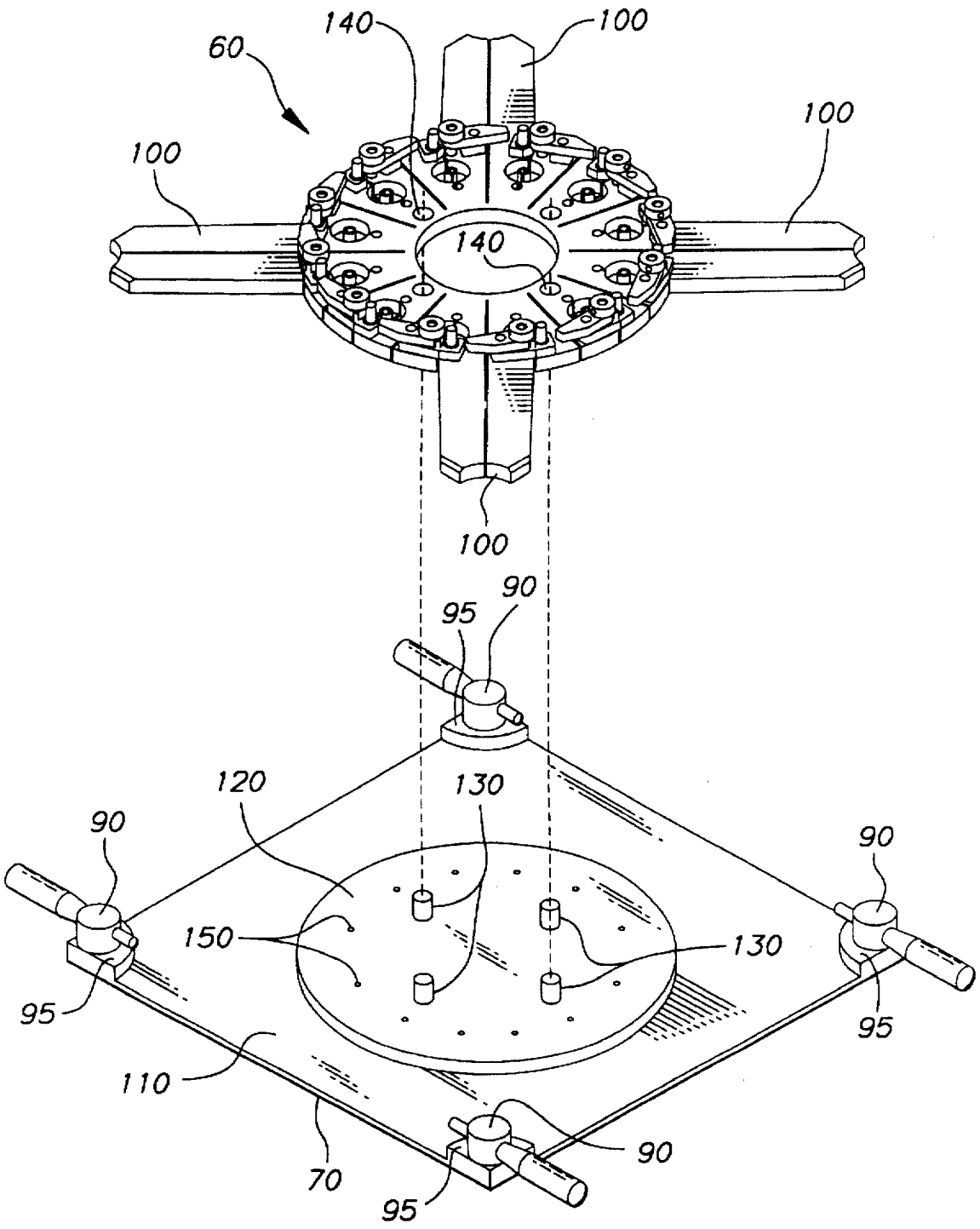
FIG. 2 is an exploded isometric view of the universal polishing fixture and a setup plate, wherein the universal polishing fixture can accommodate connectors of many diameters.

Referring to FIG. 2, a setup plate 70 provides for uniform protrusion of the ferrule 190 from the polishing fixture 60. The fixture 60 is secured to the setup plate 70 so that the connectors can be uniformly vertically positioned in the polishing fixture 60. The polishing fixture 60 has securing plates 100. Tightening lugs 90 on the setup plate 70 rotate to retain the securing plates 100 to the setup plate 70. The setup plate 70 comprises a base member 110 and a circular reference surface 120 positioned integrally and substantially at the center of the base member 110. Second reference surfaces 95 are under the lugs 90. The second reference surfaces 95 receive the securing plates 100 and serve to position the fixture over the reference surface The reference surface 120 has four registration pins 130 extending upwardly and away from the reference surface 120. The registration pins 130 engage a reciprocal set of registration holes 140 on the polishing fixture 60. A series of clearance holes 150 are disposed around the circumference of the reference surface 120. Each hole 150 is of sufficient diameter to allow an optical fiber to be received therein while providing mechanical interference between the ferrule endface and the reference surface 120. The registration pins 130 mechanically engage the registration holes 140 on the polishing fixture 60 so that the clearance holes 150 on the reference surface 120 align with fibers in terminated ferrules 190 held by the polishing fixture 60.

Figure 3:
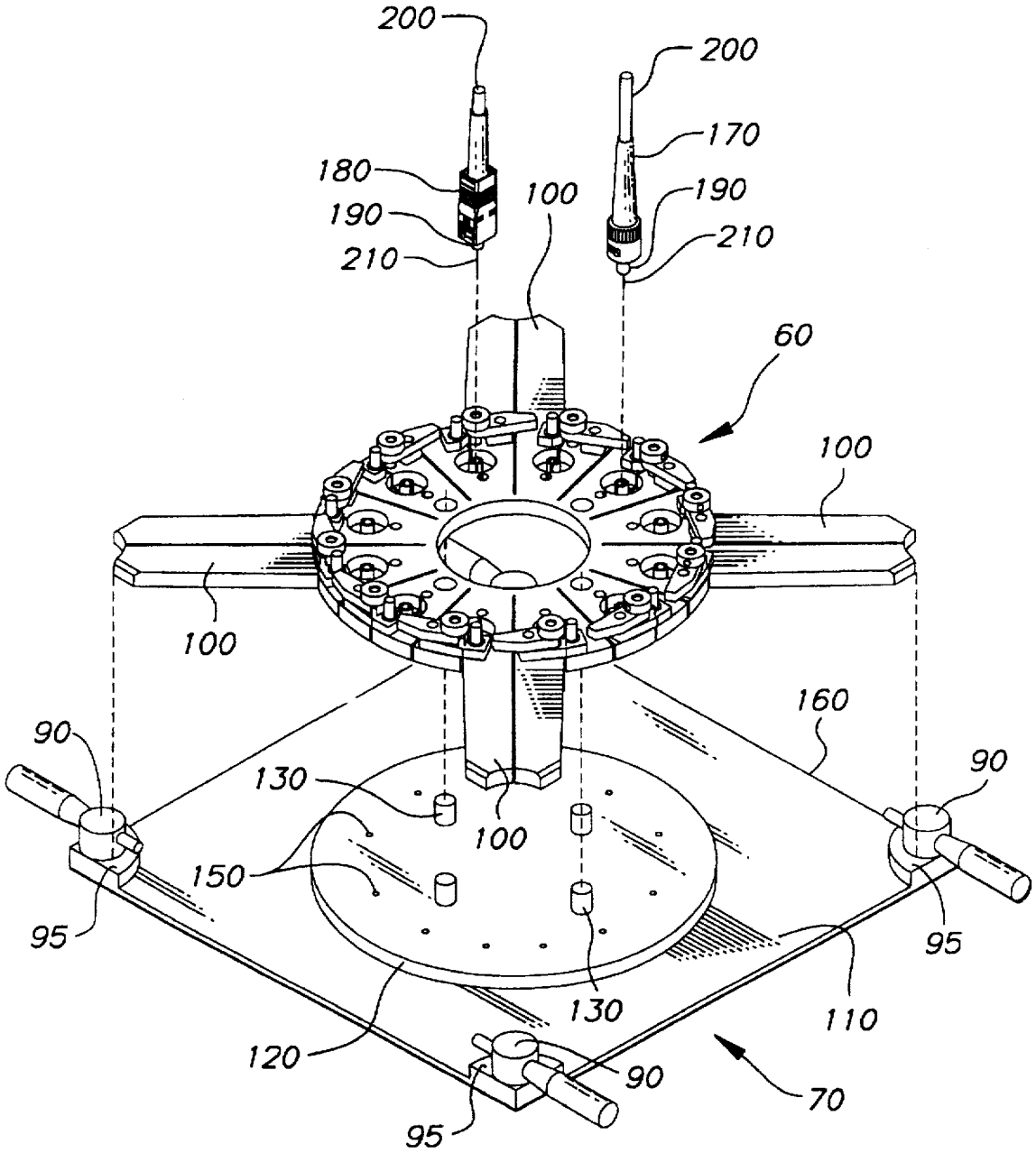
FIG. 3 is another view of the universal polishing fixture and setup plate in accordance with the present invention having connectors housed on the polishing fixture.

Referring to FIG. 3, it can be seen that differing connector geometries can be received by the polishing fixture 60 for polishing the fibers and ferrules found in the connectors. For example, and not intending to be limited by any particular geometry, an SC style connector is shown at 170, and an ST style FSD connector is shown at 180. The polishing fixture 60 and setup plate 70160 provided in accordance with the present invention ensure that both of these connectors can be polished simultaneously, and that a uniform ferrule protrusion is achieved. The polishing fixture 60 is adapted to secure the connectors with varying geometries as will be described more fully below. The polishing fixture as shown accommodates ferrules in connectors of varying geometries having substantially similar diameters. Alternatively, a polishing fixture according to the invention may accommodate ferrules of different diameters.

In practicing the invention, the ferrules 190 are placed through holes in the polishing fixture and shoulder against the reference surface 120. The fibers protruding from the ferrules interface in the clearance holes 150. In this manner, the connectors of varying geometries are set up in the polishing fixture so that the ferrules uniformly protrude therefrom. The connectors are then clamped in position on the polishing fixture 60 and removed from the setup plate 70. The polishing fixture with ferrules uniformly protruding therethrough is then clamped on the polishing machine 10 so that the fibers and ferrules can be polished.

Figure 4:
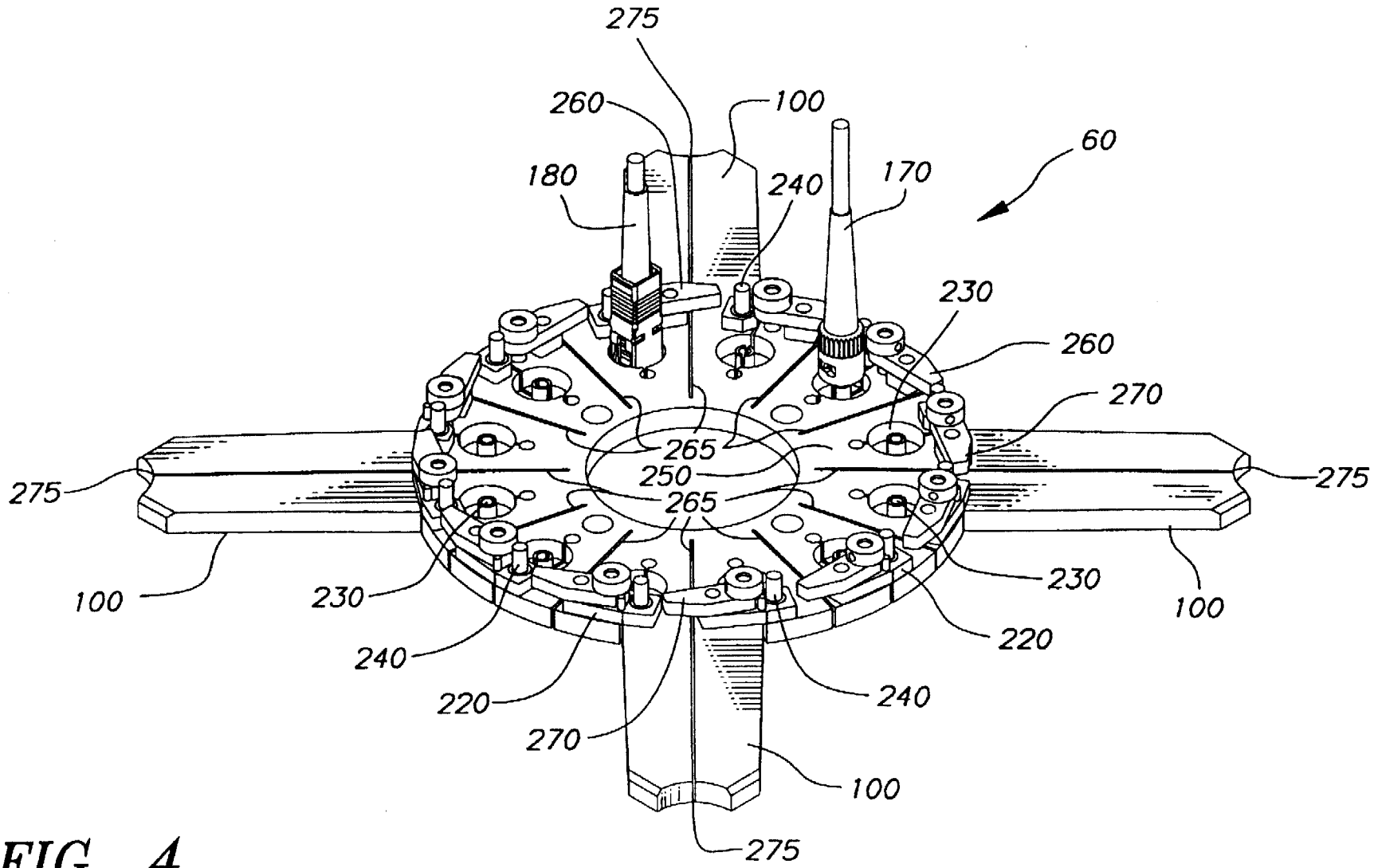
FIG. 4 shows the polishing fixture with clamps to accommodate connectors of varying geometries.

As can be seen in FIG. 4, the SC style connector 170 and ST style connector 180 having dissimilar connector geometries are placed in the polishing fixture 60. The ferrules extend through the bottom of the polishing fixture (not shown in FIG. 4) and the fixture itself is provided with clamping members shown generally at 220 for securing therein the connectors of varying geometries so that they can be efficiently polished.

The clamps 220 are ferrule clamping devices which consist of a pair of links 221,222 that are pivotally attached to movable portions 223, 224 of nests 230 in which the connectors 170 and 180 reside. The nests receive and hold the terminated ends of the ferrules of the connectors of 170 and 180 and further steady and hold the ferrules in position in the polishing fixture. Clamps of this construction are described in U.S. Pat. No. 5,321,917, Franklin et al., which is owned by the assignee of the present invention. The teachings of the Franklin et al. patent are specifically incorporated herein by reference.

In accordance with the teachings of the Franklin et al. patent, each of the clamps 220 includes the pair of links, three bushings, 225,226 lone bushing not shown and a retaining collar 227. One of the links contains two holes in either end which slip fit with a bushing, and the other link contains similar holes to be slip-fit with yet another of the bushings. The links are assembled at pins shown at 240 in FIG. 4 which are formed on a base plate 250 which comprises the polishing fixture. The links which form clamps 220 pivot on pins 240 and are engaged so that the clamps can be placed in two separate positions; a first position which does not clamp the connectors in the nests 230, and a second locking position which clamps and secures the connectors in the nests.

Figure 7:
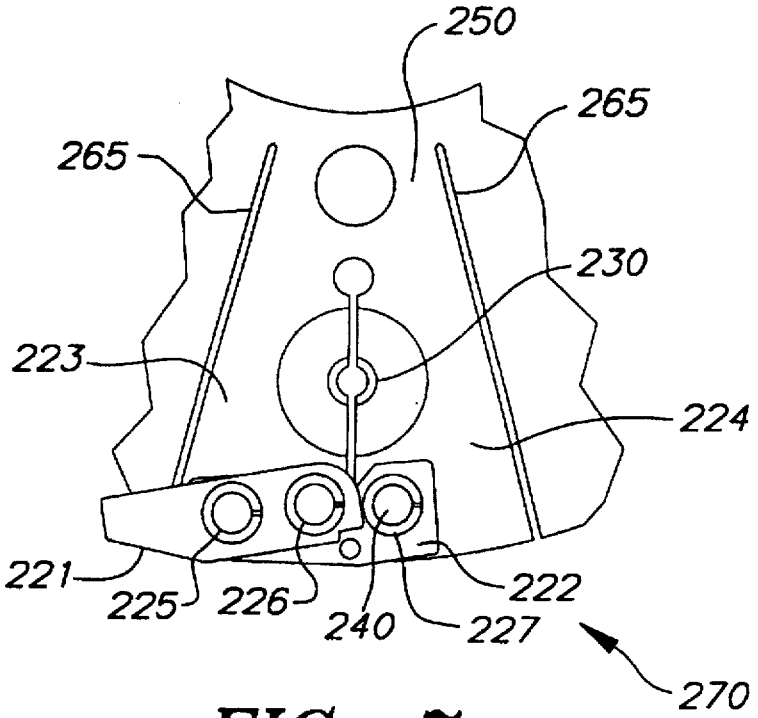
FIG. 7 is a view of a clamp in the open position to hold connectors in the fixture.
Figure 8:
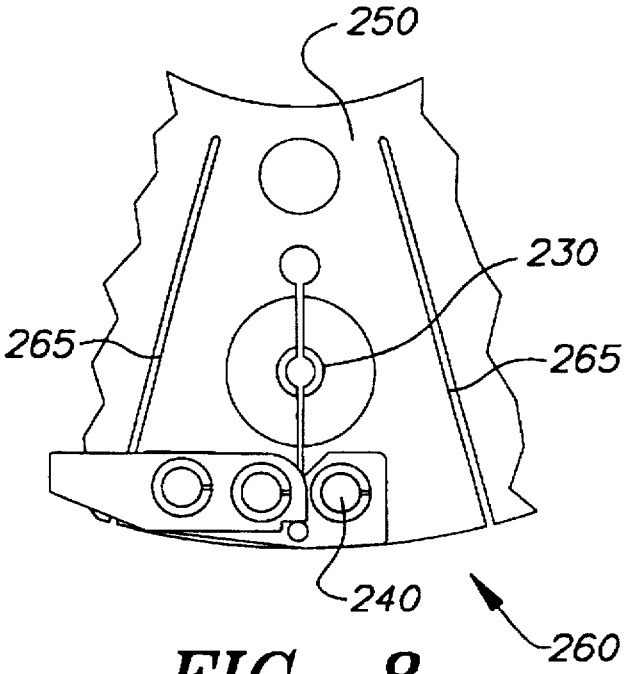
FIG. 8 is a view of the clamp of FIG. 7 in the closed position.

To secure the connectors in the nests, the clamps 230 are moved into the locked position shown at 260 on FIGS. 4, and 8. The open or unlocked position is shown in FIG. 7 therefor generally at 270 when a connector is not in the nest 230, and the nest is therefore vacant. To achieve the locked position shown at 260 with a clamp 220, pins 240 are forced together by the clamp which forces the moveable portions of nest 230 to come closer together in an elastic fashion, thereby clamping the connector and ferrule securely in the nest. Since the clamps 220 can be moved over a substantially large circular distance, the nests can accommodate a large variety of different geometry connectors therein, which is only limited by the maximum distance which the clamps can move to hold the connector in the nest. Additionally, it is preferable to provide a series of partially radial slots 265 extending radially across the fixture 60 as shown. Similar radial slots 275 are formed in securing plate 100. The radial slots permit some movement of the individual segments 223,224 of the fixture 60 which contain the nests 230. The movement allows independent clamping of each nest sufficient to hold the connectors.

Figure 5:
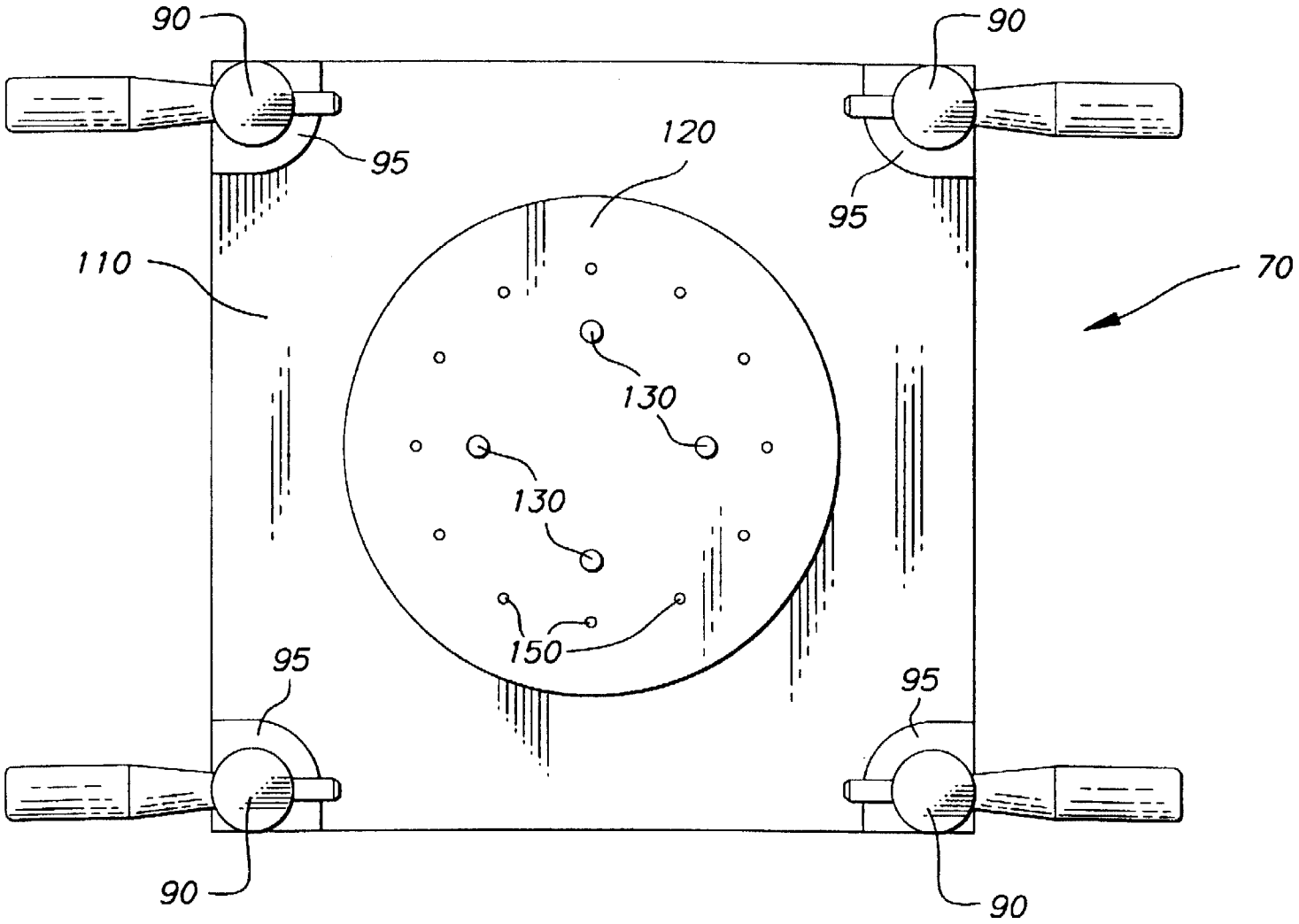
FIG. 5 is the plan view of a setup plate provided in accordance with the present invention.
Figure 6:
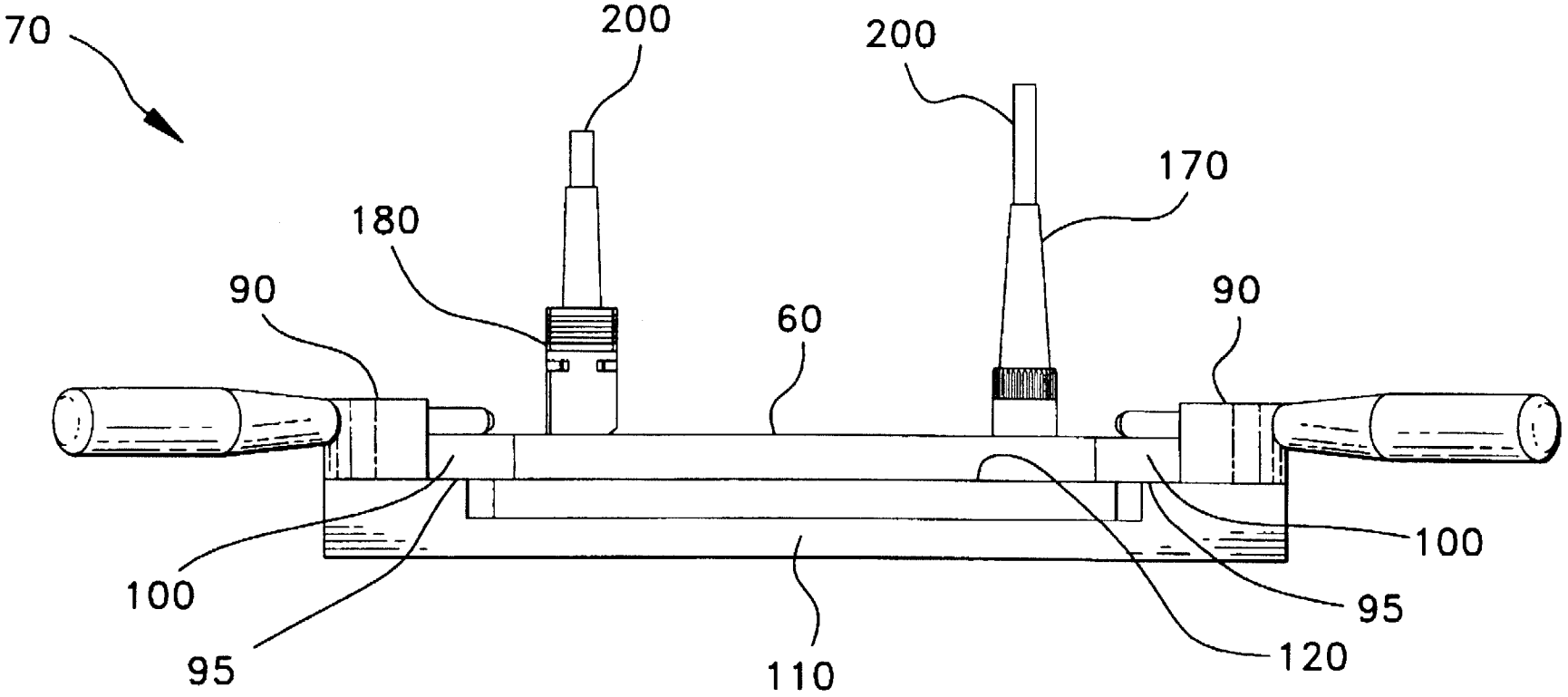
FIG. 6 is an elevational view of the setup plate and polishing fixture provided in accordance with the present invention.

Referring to FIGS. 5 and 6, the plurality of clearance holes 150 are disposed around the circumference of the reference surface 120. Each of holes 150 has a large diameter sufficient to allow the optical fibers 210 to pass therethrough, and a sufficiently small diameter to provide mechanical interference for the ferrules and connectors 170 and 180 to be shouldered against the solid portion of reference surface 120. In this manner, the reference surface 120 member to provide a substantially uniform protrusion for the ends of the ferrules from the polishing fixture. The polishing fixture as shown in FIG. 4 receives 2.5 millimeter diameter ferrules to be shouldered against the reference surface 120. This size ferrule is common to many connectors of varying geometries. Other ferrule sizes may be accommodated with an appropriate change of the diameter of the nest 230.

As shown particularly in FIG. 6, the setup plate 70 causes the fiber-optic cables 210 to uniformly and accurately protrude through the holes 150, thereby allowing the connectors to be both initially polished and repolished if necessary without repositioning on the fixture. This alleviates the need for shimming up the polishing surface to obtain enough pressure on the connector so that polishing can be efficiently accomplished which greatly reduces the labor time involved in operating polishing machine provided in accordance with the present invention. Furthermore, the interaction of reference surface 120 and second reference surfaces 95 causes the fixture 60 to be placed in the correct position on setup plate 70, thereby ensuring that the connectors are placed in the proper position on machine 10 during polishing.

Thus polishing fixtures, setup plates and polishing machines claimed and described herein allow for polishing connectors of varying geometries at the same time. This greatly reduces the cost of polishing connectors and also increases the efficiency of the polishing process. Furthermore, the setup plates described herein ensure accurate and uniform protrusions of ferrules from polishing fixtures, thereby ensuring uniform polishing of any type of connector which is placed on the machine. These results have not heretofore been achieved in the art, and greatly increase the efficiencies of connector polishing, which reduces costs.

There have thus been described certain preferred embodiments of polishing fixtures, setup plates and polishing machines provided in accordance with the present invention.

While preferred embodiments have been described and disclosed, it will be recognized by those with skill in the art that modifications are within the true spirit and scope of the invention. The appended claims are intended to cover all such modifications.

What is claimed is:

1. A setup plate for positioning at least one fiber optic connector in a polishing fixture, the connector comprising a ferrule holding an optical fiber and having an endface, the setup plate comprising:

a base member for holding the polishing fixture in registration with an alignment member; and the alignment member being formed on a portion of the base member which provides mechanical interference with the ferrule endface to provide a substantially uniform protrusion for the ends of the ferrules from the polishing fixture.

2. The setup plate recited in claim 1 wherein the alignment member further comprises a reference surface having a plurality of clearance holes disposed in the reference surface, wherein the clearance holes are adapted to receive the fiber held by the ferrule.

3. The setup plate recited in claim 2 wherein the reference surface further comprises at least two registration pins for holding the reference surface in registration with the polishing fixture.

4. The setup plate recited in claim 1 wherein the base member further comprises a plurality of tightening lugs for securing the polishing fixture to the base member.

5. An apparatus for setting up at least one fiber optic connector in preparation for polishing, said connector comprising a ferrule holding a fiber, said apparatus comprising:

a base member for holding a polishing fixture in registration with a reference member;

said reference member being formed on the base member;

a plurality of clearance holes disposed in said reference member for receiving the fibers protruding from the ferrule; the plurality of clearance holes having a sufficiently small diameter to permit mechanical interference between an endface of the ferrule and the reference member;

said polishing fixture having a plurality of nests in a base plate;

a plurality of ferrule receiving members on the base plate and a plurality of clamping members associated with each of the plurality of ferrule receiving members and being adapted to clamp the ferrule in the ferrule receiving members.

6. The apparatus recited in claim 5 wherein the reference member comprises a circular reference plate formed integrally on top of the base member.

7. The apparatus recited in claim 6 wherein the plurality of clearance holes are disposed around the circumference of the circular reference plate.

8. The apparatus recited in claim 6 wherein the circular reference plate comprises a plurality of registration pins and the polishing fixture further comprises a plurality of registration holes in registration with the registration pins.

9. The apparatus recited in claim 6 further comprising a plurality polishing fixture securing lugs attached to said base member and a plurality of securing plates depending from the polishing fixture which are interfaced to the plurality of securing lugs on the base member.

10. The apparatus recited in claim 5 wherein the clamping members each comprise a set of links which will tighten the nests to secure the ferrule to the base plate.

* * * * *